US005243373A

United States Patent [19]

Glover et al.

[11] Patent Number: 5,243,373

[45] Date of Patent: Sep. 7, 1993

[54] PHOTOGRAPHIC PROCESSING APPARATUS

[75] Inventors: Edward C. T. S. Glover, London; Anthony Earle, Harrow Weald, both of Great Britain

[73] Assignee: Eastman Kodak Company, Rochester, N.Y.

[21] Appl. No.: 920,387

[22] PCT Filed: Feb. 7, 1991

[86] PCT No.: PCT/EP91/00256

§ 371 Date: Aug. 14, 1992

§ 102(e) Date: Aug. 14, 1992

[87] PCT Pub. No.: WO91/12568

PCT Pub. Date: Aug. 22, 1991

[30] Foreign Application Priority Data

Feb. 14, 1990 [GB] United Kingdom ..... 9003376.2

[51] Int. Cl.[5] ..... G03D 3/08

[52] U.S. Cl. ..... 354/320; 354/331; 354/339

[58] Field of Search ..... 354/297, 317, 319-324, 354/331, 336, 338, 339, 337; 134/64 P, 64 R, 122 P, 122 R

[56] References Cited

U.S. PATENT DOCUMENTS 1,178,278 4/1916 Uhl .
2,186,927 1/1940 Hughey .

FOREIGN PATENT DOCUMENTS 2622708 5/1989 France .

*Primary Examiner*—D. Rutledge
*Attorney, Agent, or Firm*—Nixon, Hargrave, Devans & Doyle

[57] ABSTRACT

A low volume thin tank photographic development apparatus has a narrow passage which has a width which is adjustable by placing strips of chemically inert material at the edges of the passage. The strips may be wound on rollers, and the strips may be stepped so that they are of different dimensions, to accommodate different webs of photographic material being processed. The use of the strips ensures that the minimum quantity of photographic processing solution is used.

10 Claims, 1 Drawing Sheet

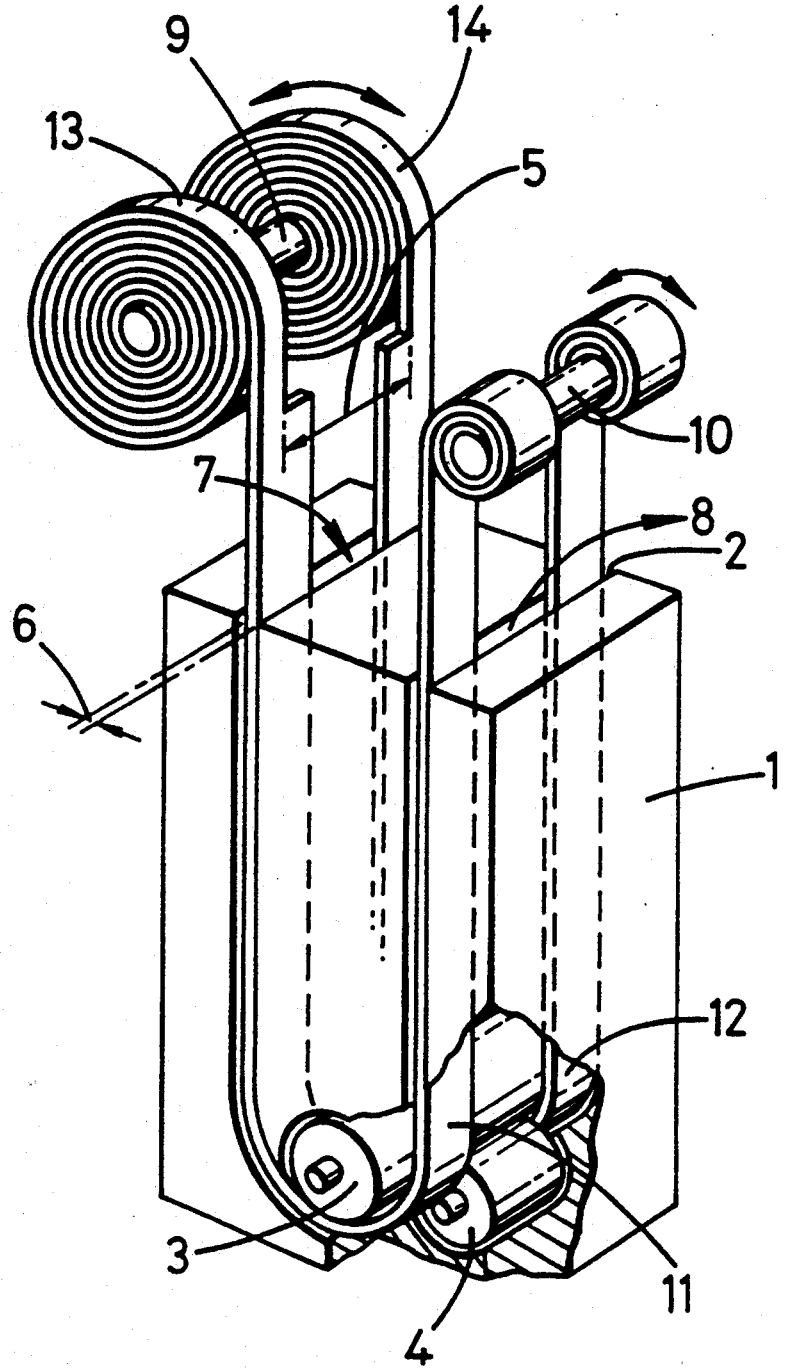
9
14
13
5
10
7
8
2
6
1
12
3
11
4

PHOTOGRAPHIC PROCESSING APPARATUS

This invention relates to photographic processing apparatus of a kind having a passage of limited dimensions to define a low volume processing area and adapted in use to receive a photographic solution through which a photographic material to be treated is arranged to pass.

Apparatus of this kind is sometimes referred to as low volume thin tank apparatus and a typical form of the apparatus are described in U.S. Pat. No. 2,186,927 and FR-A-2622708. It has been proposed that in such apparatus the ratio of tank volume to maximum area of material accommodatable therein is shown as being less than 11 $dm^3/m^2$ and preferably less than 3 $dm^3/m^2$. Replenisher is added to the tank during processing and the volume of replenisher is equal to at least twice and preferably 3 times the tank's volume in less than the time taken for the processing solution's performance to deteriorate beyond predetermined limits of acceptability. The spacings of the inner faces of the longer sides of the processing tank is required to be less than 11 mm and preferably less than 5 mm. The photographic process is to be used is preferably the REDOX amplification process.

One particular advantage of the use of low volume thin tank processing, procedures and apparatus is that the minimum of chemicals is used which has an environmentally beneficial effect since there is less demand on raw material resources and, also, any discharge which has to be treated for pollution potential is reduced to a minimum. Furthermore, the maximum efficiency can be obtained during the process as the low volume of solution used is easily able to be replenished.

A low volume thin tank processing apparatus would normally be made on a maximum width equivalent with the maximum width of material such as paper which is to be passed through it. It will be appreciated, however, that lesser widths of material can be passed through. If this is the case, then the volume of processing solution to the surface area will change away from the optimum. It is an object of the present invention to provide apparatus in which the width is variable so that the chemical effect of the solution is maximised and its quantity is minimised.

There is therefore provided, according to an aspect of the present invention photographic processing apparatus of the kind having a passage which defines a low volume processing chamber and is arranged so that in use it can receive a photographic solution through which a web of photographic material to be treated is arranged to pass, said passage having an inlet and an outlet and opposite side walls which define the effective width of passage, characterized in that at least one side wall is formed by a strip of chemically inert material, said strip of material being so mounted and arranged that it is either replaceable or movable to provide a side wall at a different lateral position to therefore adjust the width of the passage.

Preferably two strips of material are provided, one on either side of the tank so as to define a restricted central passage. These strips may be wound onto rollers external of the tank and the strips may be formed with steps in them so that depending on the width of material to be processed, the appropriate width of strip may be rolled off the rollers into the tank. The strips have a thickness slightly less than the thickness of the passage.

The passage itself may be formed in a narrow flat tank or, alternatively, may define a sinuous path. The sinuous path may be a simple U with the exit and the entrance to the path at the top of the tank. Preferably a central drive roller is provided within the tank to drive the material being processed through the tank. The edges of the tank and the tank width narrowing means may conveniently be provided with grooves or slots to guide the edges of the web being treated.

In order that the invention may be readily understood, one example of apparatus in accordance therewith may now be described with reference to the single schematic FIGURE of the accompanying drawing.

This FIGURE shows in perspective terms a thin low volume tank of photographic apparatus for developing exposed photographic images carried on a paper web.

The tank comprises a general body 1 having a U-shaped passage 2 therein through which a web of photographic material (not shown) passes. At the bottom of the U there is fixed a pair of rollers. A larger roller 3 spans the width of the tank 1 and the web is passed around this roller and is driven by a smaller drive roller 4 centrally positioned in respect of the roller 3. The web material passes through the nip between the rollers 3 and 4 and is progressed by them through the tank. The rollers can be seen clearly from the cut-away section in the FIGURE. The passageway has a maximum width 5 which is equivalent to the maximum dimension of web which can be processed and it has a thickness 6 which in this example is 5 mm.

The passage contains colour development solution and this is constantly replenished at the entrance 7 to the passage 2.

Above the entrance 7 and above the exit 8 of the passage 2, there are situated respectively two rollers 9 and 10 which contain strip material of a chemically inert nature, such as polypropylene, and as can be seen in the FIGURE the strips have a wider portion 11 and 12 respectively which, in the example shown, depend from rollers 9 and 10 through the body of the tank in the passageway 2 at the edge of the passageway 2 so defining a restricted passage.

It will be seen that the roller 9 also carries lengths of the strip which are of less dimensions than those 11 and 12. These strips 13,14 respectively have dimensions of about half of those of the portions 11,12 and can be fed into the tank when a different size of web is to be processed. Thus, as shown, the tank is set up for the minimum web width to be fed into the entrance 7 of the tank, whereas if the next intermediate size of web were to be fed in then the roller 10 would be rotated to draw onto it all the portions 11 and 12 so that the portions 13 and 14 would lie in the passage 2. If the whole width of the passage was to be used for the maximum size web then either none of the strip material is necessary or only a very thin piece of no substantial dimensions is connected as a draw so that when the dimensions are to be changed the rollers can be rotated to pull in the appropriate size portions of strip. The thickness of the strip is such as to allow it freely to move within the passage 2, but with the minimum of free area so that the volume of solution in the passage 2 is reduced.

In operation the rollers 9 and 10 are adjusted for the width of paper to be treated and the passage 2 is filled with solution. The web of material is fed into entrance 7 and when it reaches the nip between the rollers 3 and 4 is drawn through and ejected from the exit 8 of the tank. At the same time, replenisher for the solution is constantly fed into the entrance 7 so that the web is taking round fresh solution with it all the time for the duration of the developing process. The timing of the process depends on the speed of transfer of the web through the tank and this is controlled by the drive rate of roller 4 for a particular application.

The internal edges of the strip portions 11,12 have small grooves (not shown) in which the web can run to assist its passage through the tank.

It will be appreciated that since the effective width of the tank can easily be adjusted dependent on the width of the web, there is always the minimum effective volume of solution present in the tank for the development process taking place and there is no surplus of solution. This means that the cost of the operation is reduced to a minimum and there is also the minimum of solution to be treated before disposal as effluent. The invention therefore provides a very effective clean method of processing various widths of webs.

We claim:

1. Photographic processing apparatus of the kind having a passage which defines a low volume processing chamber and is arranged so that in use it can receive a photographic solution through which a web of photographic material to be treated is arranged to pass, said passage having an inlet and an outlet and opposite side walls which define the effective width of passage, characterized in that at least one side wall is formed by a strip of chemically inert material, said strip of material being so mounted and arranged that it is either replaceable or movable to provide a side wall at a different lateral position to therefore adjust the width of the passage.

2. Apparatus as claimed in claim 1 characterized in that there are two strips of material arranged one each side of the passage.

3. Apparatus as claimed in claim 1 characterized in the strip or strips are wound on rollers situated externally of the tank.

4. Apparatus as claimed in claim 1 characterized in that the strip or strips are stepped.

5. Apparatus as claimed in claim 1 characterized in that strip has a thickness slightly less than the thickness of the passage.

6. Apparatus as claimed in claim 1 characterized in that the passage is formed in a narrow flat tank.

7. Apparatus as claimed in claim 1 characterized in that the passage has a sinuous path.

8. Apparatus as claimed in claim 7 characterized in that the passage is of a general U shape.

9. Apparatus as claimed in claim 1 characterized by including a central drive roller extending into the passage to drive a web of material being processed therethrough.

10. Apparatus as claimed in claim 1 characterized in that an edge of the strip has a groove therein to receive the side of the web being processed.

* * * * *